US005312274A

United States Patent [19]

Tuao

[11] Patent Number: 5,312,274

[45] Date of Patent: May 17, 1994

[54] CONTROLLER OF DECORATIVE LIGHT SETS

[76] Inventor: Shuan-Guan Tuao, No. 61-10, Ta-Tsuo, Ta-Tsuo Li, Chunan, Miaoli, Taiwan

[21] Appl. No.: 8,351

[22] Filed: Jan. 22, 1993

[51] Int. Cl.[5] ..... H01R 17/00

[52] U.S. Cl. ..... 439/660; 439/452

[58] Field of Search ..... 439/76, 78, 223, 709–717, 439/554, 555, 660, 452

[56] References Cited

U.S. PATENT DOCUMENTS 4,023,879 5/1977 Braund et al. ..... 439/223
5,000,690 3/1991 Sonobe et al. ..... 439/76
5,020,996 6/1991 Cheng ..... 439/76
5,091,826 2/1992 Arnett et al. ..... 439/76
5,096,427 3/1992 Sadigh-Behzadi ..... 439/76

*Primary Examiner*—David L. Pirlot
*Attorney, Agent, or Firm*—Morton J. Rosenberg; David I. Klein

[57] ABSTRACT

A controller relates to a controller for decorative light sets, which has been provided with a connecter having flutes which can engage with several electric wires of light sets easily and lets every metal terminal of wires contact directly with a related metal piece on an IC board in the controller for an electrical connection.

2 Claims, 4 Drawing Sheets

CONTROLLER OF DECORATIVE LIGHT SETS

BACKGROUND OF THE INVENTION

As known, a controller is used in a decorative light sets to control each light set to twinkle independently. A known electric circuit of the controller is shown in FIG. 1. It is understood that each electric wire 5 of the light sets must be connected with an IC board 4. In prior art, the wires 4 are welded to the IC board 4. As a result, a producer must produce the IC board 4 first and then sends them to the light-set department. After welding electric wires on the IC board, the assembly is placed in a box to form a controller. In such procedure, we find that it raises the rate of damage during transportation and limits the produced amount because of the serial manufacturing. Another drawback occurs since the strength of the welding is not enough. The electric wires are possibly separated from the IC board during assembling and the light sets will be out of work.

SUMMARY OF THE INVENTION

It is an object of the present invention to mitigate and/or obviate the above-mentioned drawbacks of prior art controllers in the manner set forth in the description of the preferred embodiment.

A primary object of the present invention is to provide a controller connecter which is provided with flutes on both sides to engage with electric wires easily and then to be assembled in the controller for electrical connection.

Another object of the present invention is to provide a controller connecter having flutes which include different sizes to engage with different wires having different sizes.

Further objects and advantages of the present invention will become apparent as the following description proceeds, and the features and novelty are characterized in the claims annexed to and forming a part of this invention.

DESCRIPTION OF THE PREFERRED EMBODIMENTS

Figure 1:
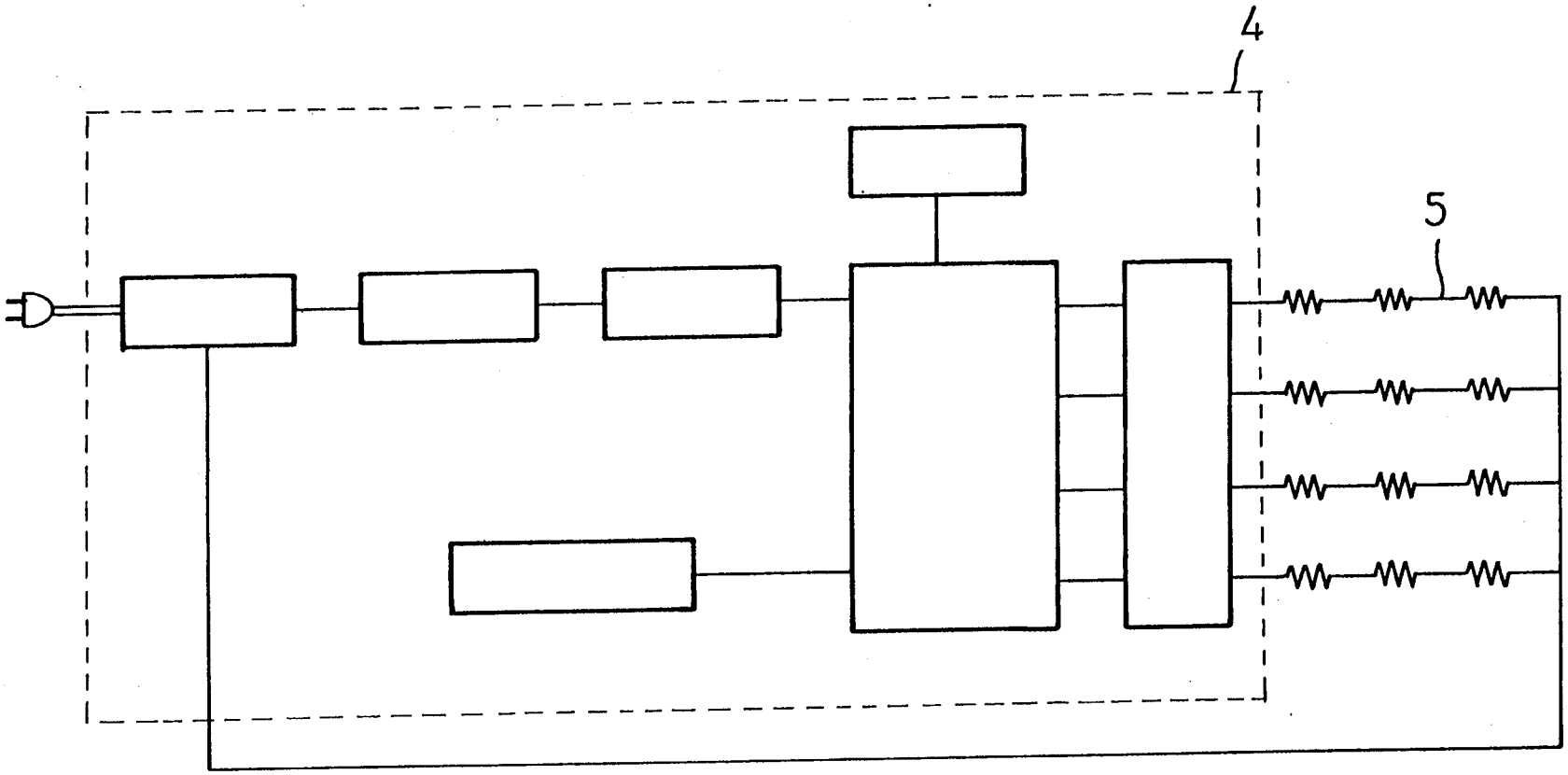
FIG. 1 is an electric circuit of a normal controller used in a decorative light sets.
Figure 2:
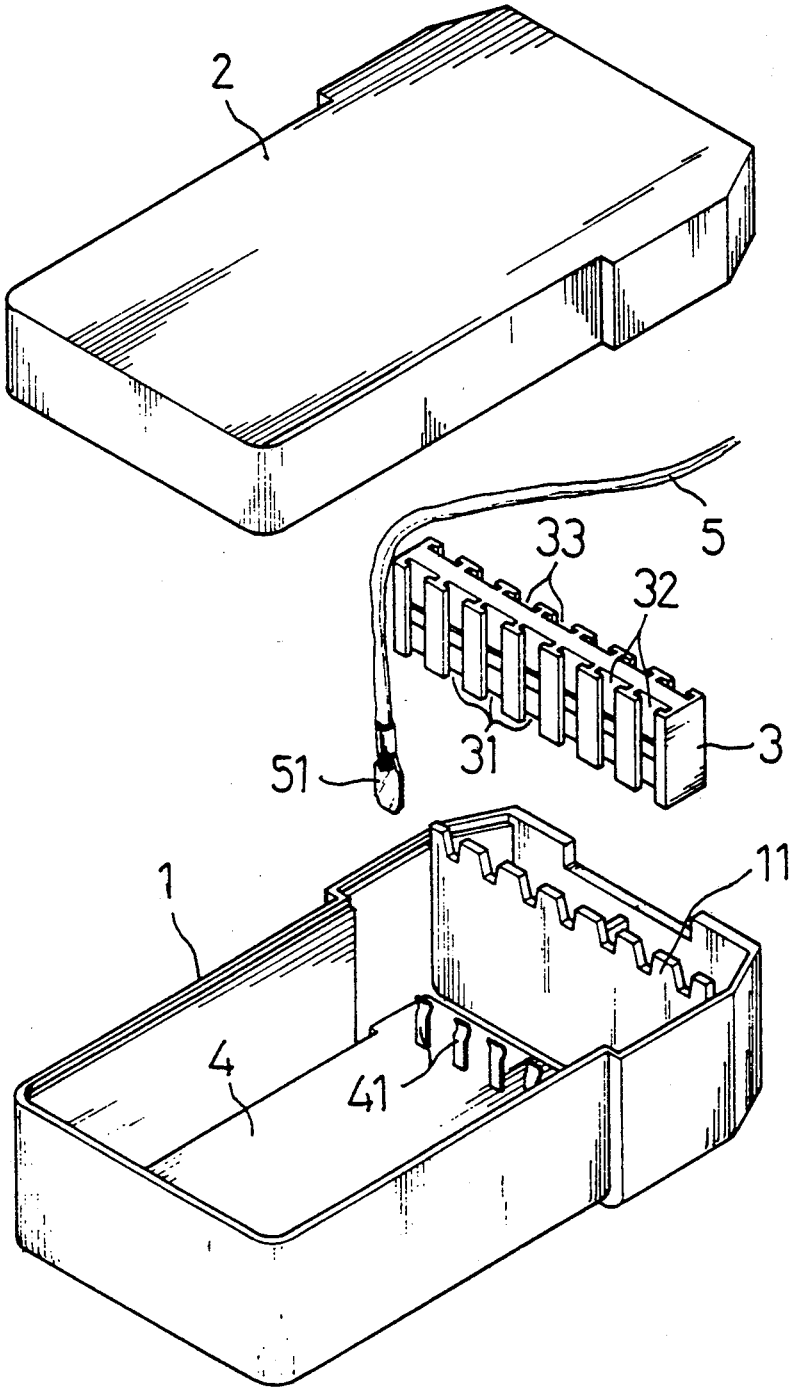
FIG. 2 is an exploded perspective view of a controller in accordance with the present invention.
Figure 3:
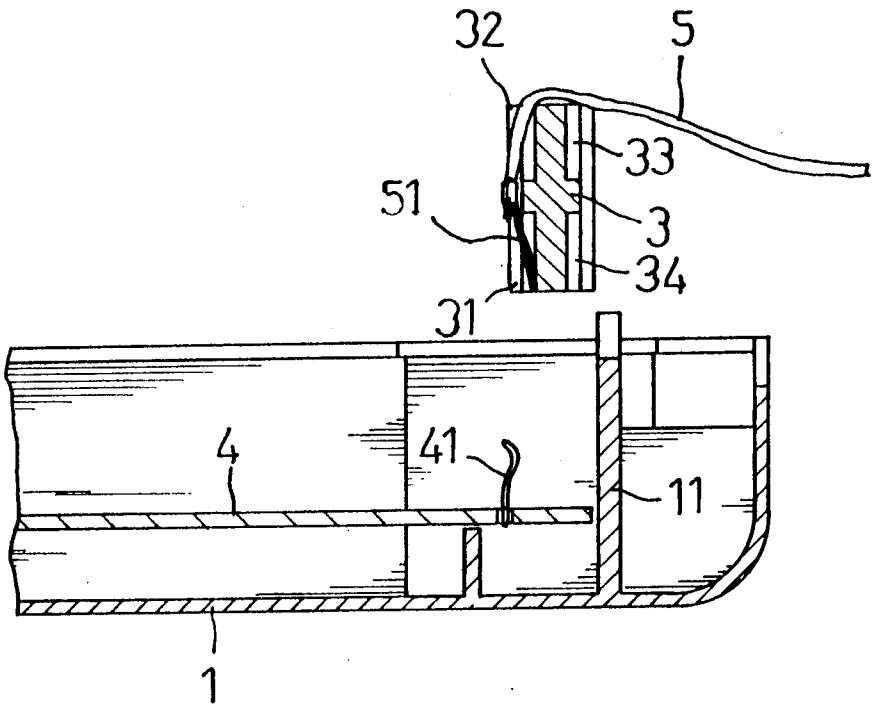
FIG. 3 is a part cross-sectional plan view of FIG. 2 in accordance with the present invention.
Figure 4:
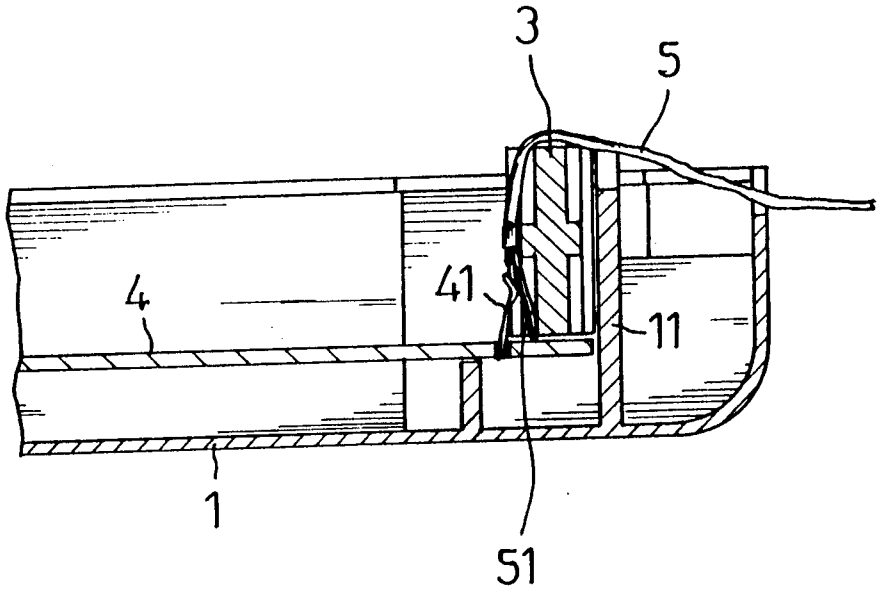
FIG. 4 is a part cross-sectional plan view after assembly of FIG. 3 in accordance with the present invention.

Referring to FIG. 2 and 3, a controller of this invention includes a box 1, a cover 2, and a connecter 3. The box 1 is formed with a stand 11 therein and a IC board 4 is placed in the box 1. Several upward conductors 41 are provided on the IC board 4 and are near to the stand 11. The cover 2 covers the box 1 to close the controller. The connecter 3 is formed with four sets of flutes 31, 32, 33, and 34 on both top and bottom sides. Each flute set has different size to engages with different electric wires used under different voltages in different countries. For example, the flutes 31 of the connecter 3 is adapted to a metal terminal 51 of a electric wires 5.

After each terminal 51 of the wires 5 of the light sets or the power sources, the connecter 3 accomplaied with all metal terminals 51 is assembled in the box 1 between the conductors 41 and the stand 11. It can be found that when the assembly is finished, each conductor 41 contacts directly with a related terminal 51 and the electrical connection between the electric wires and the IC board is completed.

Due to the above structure of the present invention, the controller will be easily manufactured. The IC board and the light set can be produced separated and then be assembled by the connector quickly. The connection between the electric wires and the connector is secure from separation because the terminal of the wire is hooked in the inner bottom side of the connecter. When pulling the wires outwards, the connection will be more tight. It overcomes the drawback of welding connection in prior art system.

As various possible embodiment might be made of the above invention without departing from the scope of the invention, it is to be understood that all matter herein described or shown in the accompanying drawings is to be interpreted as illustrative and not in a limiting sense. Thus, it will be appreciated that the drawings are exemplary of a preferred embodiment of the invention.

I claim:

1. A controller for decorative light sets comprising:

(a) a box member forming an open internal chamber for placement of an IC board having a plurality of vertically directed conductors extending therefrom;

(b) a substantially planar stand member located within said internal chamber of said box member between said plurality of conductors and an end wall of said box member, said stand member having a plurality of transversely extending notches formed within an upper surface thereof for insertion therein of a plurality of electric wires;

(c) a cover member for engagement with an upper section of said box member for closing said box member and forming a closed internal chamber; and, (d) a connector member insertable within said box internal chamber for positional location between said plurality of conductors and said stand member, said connector member having a plurality of vertically directed sets of flutes extending in a transverse direction, each of said sets of said flutes having an upper flute portion and a lower flute portion divided by a connector lug member extending from a side surface of said connector member, said electric wires passing within at least one of said notches and within at least an upper flute portion, over said connector lug member and into said lower flute portion, terminating in a metal terminal of said electric wires for contact with at least one of said conductors.

2. The controller for decorative light sets as recited in claim 1 where said plurality of vertically directed flutes include differing predetermined transverse dimensions for insert therein of correspondingly dimensioned electrical wires adapted for differing voltage requirements.

* * * * *